US005289155A

United States Patent [19]

Okumura et al.

[11] Patent Number: 5,289,155

[45] Date of Patent: Feb. 22, 1994

[54] POSITIVE TEMPERATURE CHARACTERISTIC THERMISTOR AND MANUFACTURING METHOD THEREFOR

[75] Inventors: Takuji Okumura; Hiroshi Inagaki; Yukie Suzuno, all of Kanagawa, Japan

[73] Assignee: Kabushiki Kaisha Komatsu Seisakusho, Tokyo, Japan

[21] Appl. No.: 855,642

[22] PCT Filed: Sep. 10, 1991

[86] PCT No.: PCT/JP91/01202

§ 371 Date: May 6, 1992

§ 102(e) Date: May 6, 1992

[87] PCT Pub. No.: WO92/04720

PCT Pub. Date: Mar. 19, 1992

[30] Foreign Application Priority Data

Sep. 10, 1990 [JP] Japan ..... 2-239317

[51] Int. Cl.[5] ..... H01C 7/10

[52] U.S. Cl. ..... 338/22 SD; 338/324; 338/327; 338/328; 338/22 R

[58] Field of Search ..... 338/22 SD, 22 R, 324, 338/327, 328; 204/192.21, 192.25

[56] References Cited

U.S. PATENT DOCUMENTS

| | | | |
|---|---|---|---|
| 3,975,307 | 8/1976 | Matsuo et al. | 252/520 |
| 4,232,214 | 11/1980 | Shioi et al. | 338/22 R X |

FOREIGN PATENT DOCUMENTS

| | | |
|---|---|---|
| 0235749 | 9/1987 | European Pat. Off. . |
| 48-99689 | 12/1973 | Japan . |
| 61-105803 | 5/1986 | Japan . |
| 62-016163 | 6/1987 | Japan . |
| 62-199001 | 9/1987 | Japan . |
| 62-282401 | 12/1987 | Japan . |
| 1-287902 | 11/1989 | Japan . |
| 2-027709 | 1/1990 | Japan . |
| 2146488 | 4/1985 | United Kingdom . |

*Primary Examiner*—Marvin M. Lateef

*Attorney, Agent, or Firm*—Varndell Legal Group

[57] ABSTRACT

A positive characteristic thermistor, in which the outer periphery of a first electrode including a metal other than silver as its main component is positioned on the inside of the outer periphery of the main body of this thermistor, and is made to coincide with the outer periphery of a second electrode which includes silver as its main component and formed on the first electrode or to be placed on the inside of the periphery of the second electrode.

6 Claims, 4 Drawing Sheets

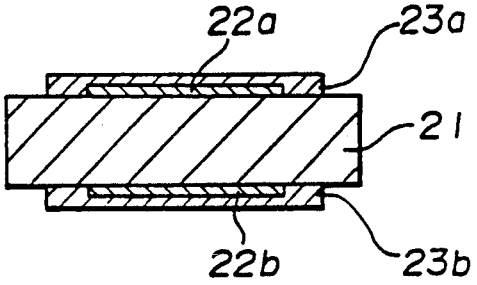
FIG. 4
FIG. 5(a)
(PRIOR ART)
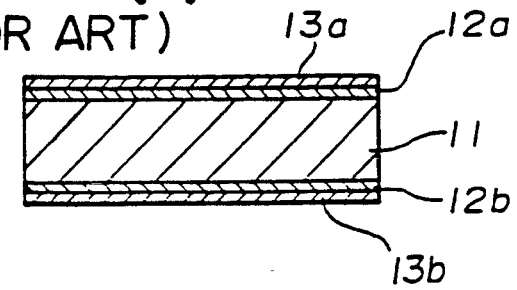
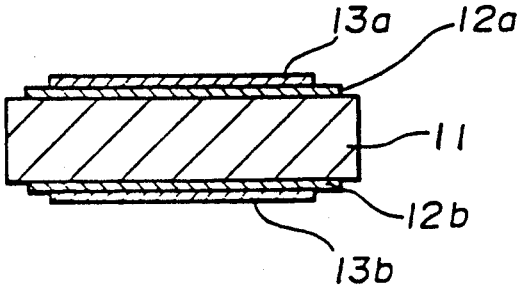
FIG. 5(b)
(PRIOR ART)

(Ta=60±3°C, Vin=270Vrms)

POSITIVE TEMPERATURE CHARACTERISTIC THERMISTOR AND MANUFACTURING METHOD THEREFOR

TECHNICAL FIELD

The present invention relates to a positive characteristic thermistor and a manufacturing method therefor, and more particularly, to structures of electrodes used in such a positive characteristic thermistor and also to a manufacturing method therefor.

BACKGROUND ART

An oxide semiconductor made of $BaTiO_3$ added with 0.1–0.3 at % of Y, Nd or the like, which has a large positive temperature coefficient, is known as "PTC thermistor".

The PTC thermistor, which can adjust its temperature range having large positive temperature coefficient by adding Sr, Pb or the like thereto, has been increasingly indispensable in various fields including temperature measurement, excess current prevention, motor start, a circuit element for demagnetization in a color television, and a constant temperature heater.

Such a thermistor comprises, as shown as an example in FIG. 5(*a*), a thermistor main body 11 of a thin cylindrical shape made by sintering an oxide, carbonate, nitrate or chloride of metals such as Ba, Ti, Nd or the like, first electrode layers 12*a* and 12*b* as Ni plated layers formed on upper and lower surfaces of thermistor main body, and second electrode layers 13*a* and 13*b* including silver as their main component and formed on the first electrode layers respectively.

Meanwhile, such a positive characteristic thermistor is usually used by applying a voltage across the second electrode layers 13*a* and 13*b*, in which case a so-called migration phenomenon takes place, that is, the silver contained in the second electrode layers is separated and moved toward a direction of the electric field. In particular, in the case where the outer periphery of the second electrode layers are formed to reach the outer periphery of the main body 1 of the positive characteristic thermistor, the silver element is separated and moved toward the direction of the electric field on the outer peripheral surface of the main body 1 of the positive characteristic thermistor, which eventually results in an undesirable short-circuit.

In order to solve this problem, there has been proposed a positive characteristic thermistor in which, as shown in FIG. 5(*b*), the outer diameter of the second electrode layers is smaller than that of the first electrode layers.

This structure, however, has had a problem that, since the contour of the second electrode layers is smaller than that of the first electrode layers, those parts of the first electrode layers not covered with the second electrode layers are exposed directly to atmosphere, which results in that those parts of the first electrode layers are liable to be oxidized and a contact resistance gradually increases.

Further, since the silver migration is a phenomenon in which the silver is separated and moved along the direction of the electric field, even when the second electrode layers alone are provided inside of the outer periphery as in the prior art, the silver is still diffused into the first electrode layers, though the quantity of the silver diffusion is very small. In this way, it has been impossible to completely prevent the above short-circuit problem, though it could be weakened.

Furthermore, since the electrode formation of the prior art positive characteristic thermistor is carried out by a known plating method, this method involves, during the Ni plating process of the electrodes, immersion of plating solution into the interior of the sintered body, thus resulting in that the characteristic of the sintered body is undesirably changed, e.g., its resistance value is decreased. This result may appear immediately after the electrode formation in the form of variations in the characteristic or may appear gradually with passage of time. As already mentioned earlier, thermistor applications require highly accurate control of its resistance value in all the fields including measurement, control and compensation of temperatures, gain adjustment, power measurement, overcurrent prevention, motor start, and demagnetization in a color television, that is, requires a range of $R \pm \alpha$ %. Accordingly, this problem of variations in the resistance value caused by the immersion of plating solution becomes serious.

Meanwhile, for the purpose of avoiding such a plating-solution immersion problem, there has been suggested to form an electrode of a metal having a low melting point such as aluminum by a metal spraying method.

However, this method also involves a problem that cracks occur in the thermistor body itself or electrodes themselves since the temperature abruptly changes during the electrode formation.

In this way, with the prior art structure having the second electrode layers formed to be smaller in the outer diameter than that of the first electrode layers, since those parts of the first electrode layers not covered with the second electrode layers are exposed directly to atmosphere, there has been a problem that those parts are liable to be oxidized and the contact resistance increases with time.

Further, in the prior art positive characteristic thermistor, the electrode formation is carried out by the plating method, which causes the immersion of plating solution into the sintered body during the Ni plating operation with the result of an undesirable change in the characteristic of the sintered body, e.g., its resistance value is decreased.

Furthermore, in case where such Ni plated layer is formed somewhat inside of the outer periphery of the thermistor main body, it is required to make a mask pattern of a resist or the like, immerse the main body into the Ni plating solution for Ni plating and then remove the mask pattern. In this case, the surface of the thermistor main body is liable to be polluted by metallic ions due to the contamination by the Ni plating solution and the stripping solution of the mask pattern, which might lead to the cause of variations in the resistance values or the cause of inducing the migration.

In this way, the prior art electrode formation methods using the Ni plating have had a problem that it is impossible to maintain favorable characteristics including a highly reliable resistance characteristic.

In view of the above circumstances, the present invention has been made to provide a thermistor having stable characteristics.

DISCLOSURE OF THE INVENTION

In accordance with the present invention, outer peripheral edges of first electrodes containing as their main component a metal other than silver are positioned inside of outer peripheral edges of a thermistor main body and also to substantially coincide with outer peripheral edges of second electrodes which are formed on the first electrodes and which contain silver as their main component.

With this structure, since end edges of the second electrode layers are located well inside of the peripheral edges of the thermistor main body, there is no possibility of short-circuit due to the migration.

Even in the case where the first electrode layers are formed so as to coincide at their outer periphery edges with the outer periphery edges of the second electrode layers, since the first electrode layers have such a structure that the first electrode layers are substantially not exposed except for the vertical parts of their ends, the first electrode layers can be prevented from being oxidized and the short-circuit due to the migration through the surfaces of the first electrode layers can be prevented, and thus their reliability can be enhanced.

Further, in the event where the first electrode layers are formed to be positioned at their ends inside of the outer peripheral edges of the second electrodes so as to cover the ends of the first electrode layers with the second electrode layers, the first electrode layers can be reliably prevented from being oxidized and the short-circuit due to the migration through the surfaces of the first electrode layers can be substantially avoided, thus their reliability can be improved.

The first electrode layer may comprise a thin film layer made of, for example, nickel, aluminum (Al), indium (In). copper (Cu), indium-gallium (In-Ga), indium-mercury (In-Hg) or the like.

In accordance with a method of the present invention, there is manufactured a positive characteristic thermistor in which the outer peripheral edges of the first electrodes containing as their main component a metal other than silver are positioned inside of the outer peripheral edges of the thermistor main body, the second electrodes containing silver as their main component are formed on the first electrodes, the formation of the first electrode layers being carried out by a vapor deposition process.

According to the method of the present invention, electrode formation can be realized by a dry process, and electrodes having a high adhesion and a small contact resistance can be formed without incurring the characteristic change due to the pollution by the solution or the like on exposed areas of the front and rear surfaces of the thermistor main body during the electrode formation.

Desirably, when the second electrode layers are formed also by the vapor deposition process, the electrodes can be sequentially formed within the same chamber and thus the manufacturing can be facilitated.

In addition, a thick film printing process may be employed for forming the second electrode layers.

BRIEF DESCRIPTION OF THE DRAWINGS

FIG. 4 shows a thermistor in accordance with a second embodiment of the present invention;

FIGS. 5(*a*) and 5(*b*) show prior art thermistors, respectively; and

BEST MODE FOR CARRYING OUT THE INVENTION

Embodiments of the present invention will be detailed with reference to the accompanying drawings.

Embodiment 1

Figure 1:
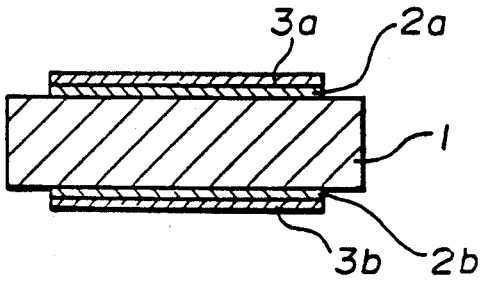
FIG. 1 shows a thermistor in accordance with a first embodiment of the present invention.

FIG. 1 shows a positive characteristic thermistor in accordance with an embodiment of the present invention.

The positive characteristic thermistor comprises a thermistor main body 1 containing barium titanium as their main component, first electrode layers 2*a* and 2*b* as Ni plated layers formed so that their end edges are positioned inside of the outer peripheral edge of the main body, and second electrode layers 3*a* and 3*b* containing silver as their main component and formed on the respective first electrode layers 2*a* and 2*b* to coincide with the first electrode layers at their end edges.

Explanation will next be made as to the manufacturing steps of the positive characteristic thermistor.

Figure 2A:
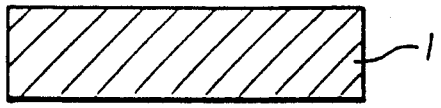
FIGS. 2(*a*) to 2(*c*) show manufacturing steps of the thermistor.
Figure 2B:
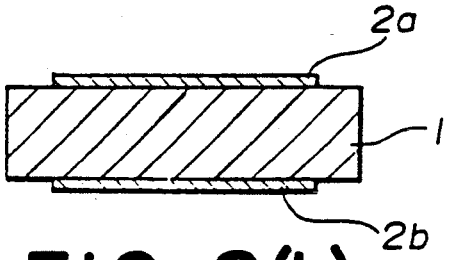
Figure 2C:
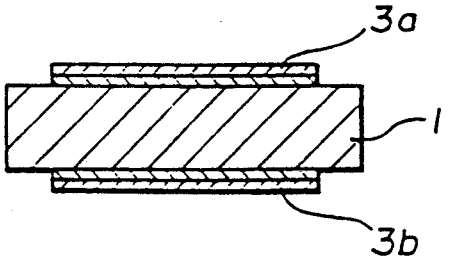

FIGS. 2(*a*) to 2(*c*) show the steps of manufacturing the thermistor in accordance with the embodiment of the present invention.

First of all, as shown in FIG. 2(*a*), powder of $TiO_2$, $BaCO_3$ and $Nd_2O_3$ are mixed at a predetermined mixture ratio, pressingly molded by cold pressing into a disk shape, and then sintered at 1300 C to form disk-shaped thermistor main body 1 having a diameter of 4.47 mm.

Subsequently, end faces (electrode forming surfaces) of the resultant thermistor main body 1 are subjected to measurements of surface roughness by a surface roughness meter.

Thereafter, the measured surface roughnesses are divided into two groups, i.e., one in which the measured surface roughnesses are within a range of 6.3 to 1.6 s (triangular marks ▽▽▽ in the Japanese Industrial Standard, (JIS)) and the other in which the roughnesses are within a range above 0.8 s (triangular marks ▽▽▽▽ in the JIS).

Nest, as shown in FIG. 2(*b*), the main body is formed on its upper and lower surfaces with first electrodes 2*a* and 2*b* as thin Ni films each having a thickness of 0.1 to 10 μm by an electron beam vapor deposition process. At this time, vapor deposition is carried out with use of a metal mask so that a thin Ni film is not formed in the vicinity of the outer periphery of the main body. In this case, the film formation conditions were set as follows.

For the measured surface roughness within the range of 6.3 to 1.6 s:

Vacuum degree: $1\times10^{-4}$ torr to $1\times10^{-6}$ torr

Film formation temperature: Room temperature to 250° C.

For the measured surface roughness within the range above 0.8 s:

Vacuum degree: $1\times10^{-5}$ torr to $1\times10^{-6}$ torr

Film formation temperature: 100° C. to 250° C.

Thereafter, as shown in FIG. 1(*c*), formed on the first electrodes are silver electrodes 3*a* and 3*b* by the thick film printing process.

Figure 3A:
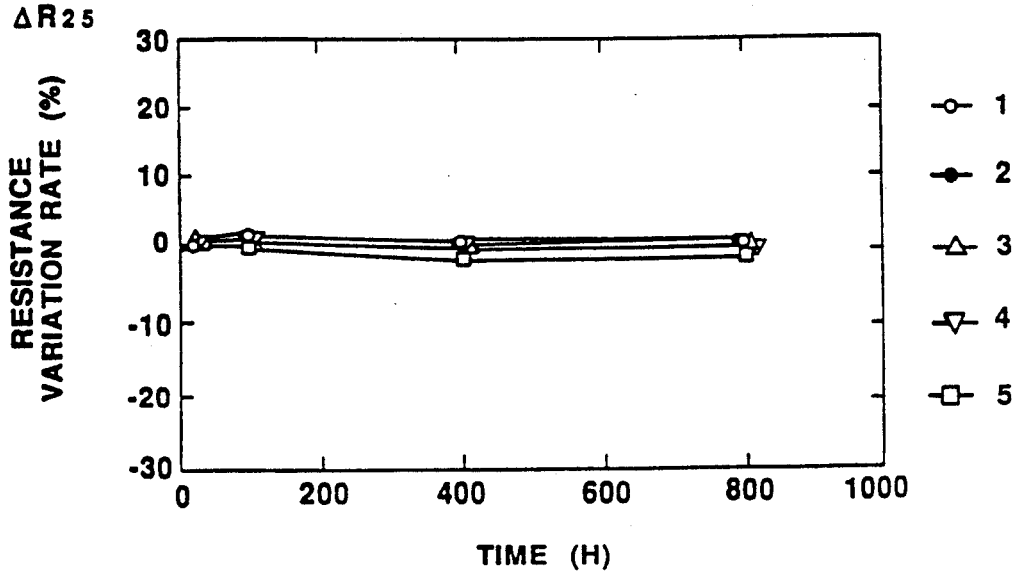
FIGS. 3(*a*) and 3(*b*) show results of aging tests conducted with respect to the thermistor in accordance with the first embodiment of the present invention and a prior art thermistor.
Figure 3B:
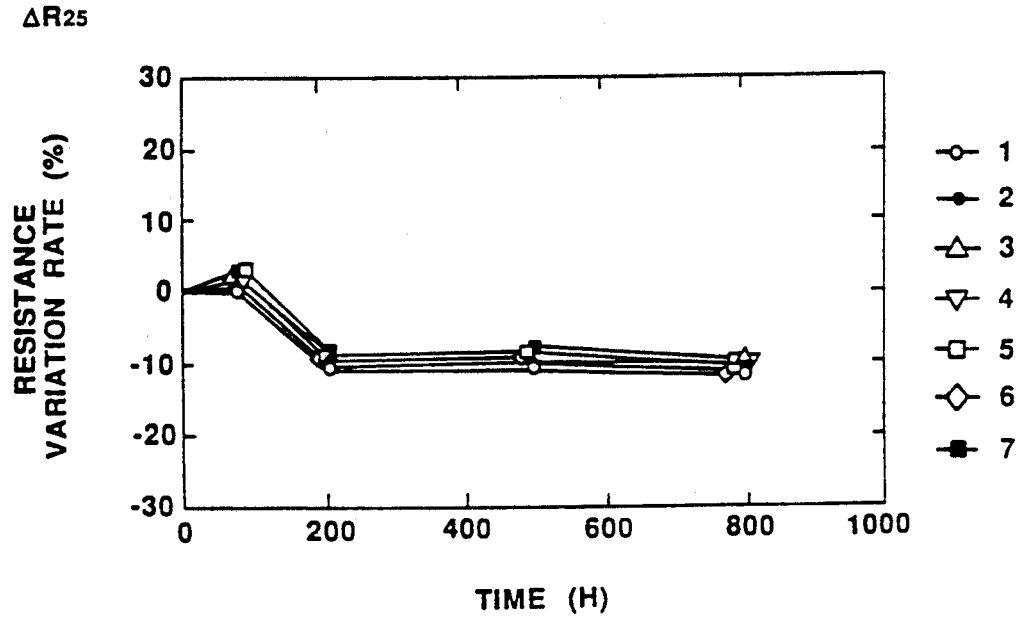

A thermistor thus obtained had a specific resistance of 23 to 28 Ωcm and had substantially no variations in its characteristic, as shown in FIG. 3(*a*), after the thermistor was subjected to aging tests at 85° C. and at 30 V with passage of 400 hours. With this structure, since the end edge of the each first electrode layer is made to coincide with that of each second electrode layer, there is no possibility that the first electrode layers are oxidized. In addition, since the first electrode layers are formed by the vacuum vapor deposition process, there can be obtained a thermistor which has excellent characteristics without variation with time.

On the contrary, when the Ni electrode parts were formed by plating, they had a specific resistance of 30 to 35 Ωcm. As a result of aging tests at 85° C. and at 30 V as same in the above, the result showed extremely unstable characteristics as illustrated in FIG. 3(*b*), that is, its resistance value started to change after passage of 100 hours, and dropped 10% after passage of 200 hours.

It will be appreciated from the comparison between the above two that, in accordance with the method of the present invention, there could be obtained a thermistor which is stable in specific resistance and high in reliability. In this method, further, since a large number of positive characteristic thermistors can be produced with one vapor deposition operation, the mass productivity can be remarkably improved.

Although the formation of the silver electrodes has been carried out by the thickness film printing in the method of the foregoing embodiment, silver vacuum vapor deposition may be effected with the metal mask being left as it is. In the latter case, since the electrode layers can be sequentially laminated within the same vacuum device only by switching vapor deposition sources, the silver electrodes can be formed very easily.

Embodiment 2

Explanation will next be made as to a second embodiment of the present invention.

The foregoing embodiment 1 has been arranged so that the first and second electrode layers have the same pattern shape. However, the present embodiment is featured in that the second electrode layers are formed to cover the end edges of the first electrode layers.

More specifically, a positive characteristic thermistor comprises, as shown in FIG. 4, a thermistor main body 21 containing barium titanium as its main component, first electrode layers 22*a* and 22*b* of Ni formed on upper and lower surfaces of the main body by the vacuum vapor deposition process so as to be located at their end edges somewhat inside of outer peripheral edges of the main body 21, and second electrode layers 23*a* and 23*b* containing silver as their main component and formed on the first electrode layers 22*a* and 22*b* so as to cover the end edges of the first electrode layers and also to be located at their end edges somewhat inside of the outer peripheral edges of the main body 21.

With this positive characteristic thermistor, since the first electrode layers 22*a* and 22*b* are formed by the vacuum vapor deposition process, substantially no pollution exists on exposed areas of the front and rear surfaces of the thermistor main body. In addition, since the first electrode layers are completely covered with the second electrode layers 23*a* and 23*b*, the first electrode layers can be prevented from being oxidized and thus can be highly reliable.

Figure 6:
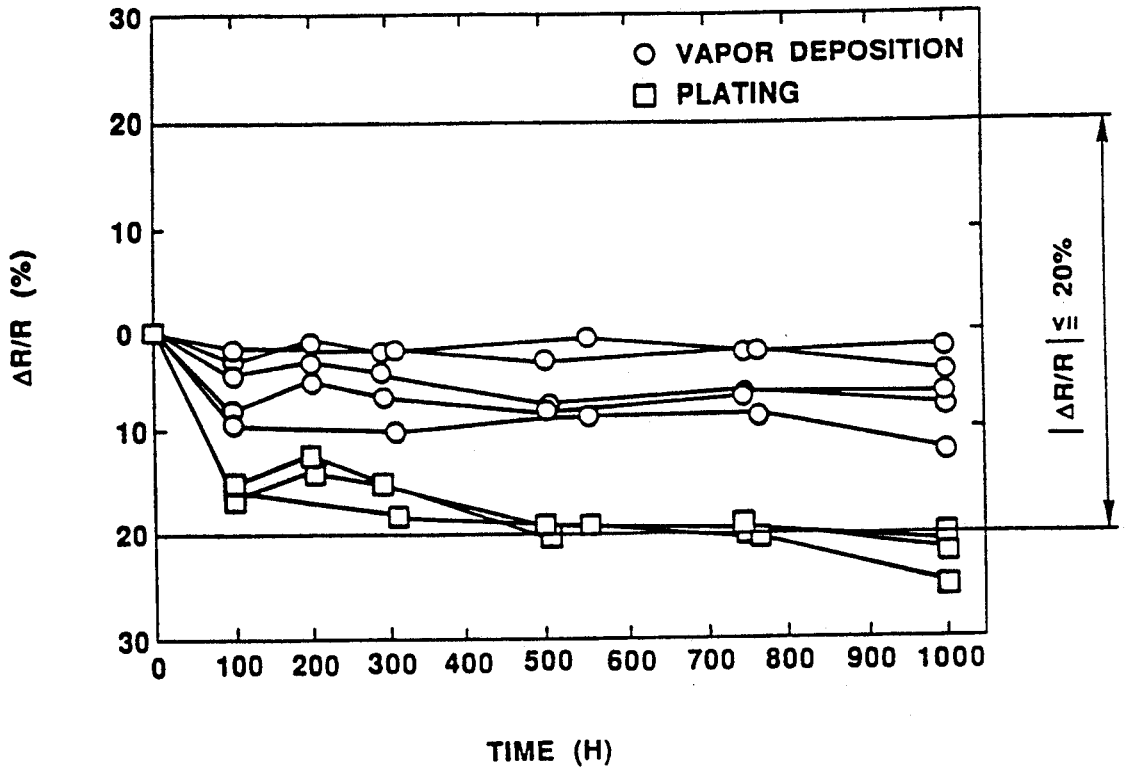
FIG. 6 shows results of aging tests conducted with respect to the second electrode layer formed by the vapor deposition process in accordance with the method of the present invention and the second electrode layer formed by the plating process in accordance with the prior art method.

For the purpose of confirming the effects resulting from the formation of the second electrode layers by the vapor deposition process, FIG. 6 shows results of aging tests at 60° C. and at 270 Vrms according to the method of the present invention and according to the prior art method using the plating process. It will be noted from these results that the second electrode layers formed by the vapor deposition process can maintain remarkably excellent characteristics without variations in the resistance value.

Industrial Applicability

As has been explained in the foregoing, in accordance with the present invention, the electrodes of the thermistor are configured by first electrode layers of electrically conductive material other than silver formed so as to be located at their end edges some what inside of the outer peripheral edges of a main body of the thermistor and electrically conductive second electrode layers containing silver as their main component formed on the first electrode layers so as to coincide at their end edges with the outer peripheral edges of the first electrode layers or to cover the outer peripheral edges of the first electrode layers. Therefore, there can be obtained a positive characteristic thermistor which is stable in characteristics and is suitably utilized in such applications which require highly accurate controls of resistance values, including measurement, control and compensation of temperature, gain adjustment, power measurement, overcurrent prevention, motor start, and demagnetization in a color television.

We claim:

1. A positive temperature characteristic thermistor characterized by comprising:

a thermistor main body made of a semiconductor material having a positive temperature characteristic;

first ohmic electrode layers containing as their main component a metal other than silver and formed on front and rear surfaces of said thermistor main body so that outer peripheral edges of said first ohmic electrode layers are located inside of outer peripheral edges of said thermistor main body; and second electrode layers made of a material containing silver as their main component and formed on said first electrode layers so that outer peripheral edges of said second electrodes layers coincide with said outer peripheral edges of said first electrode layers.

2. A positive temperature characteristic thermistor as set forth in claim 1, characterized in that said first electrode layers are of thin nickel films.

3. A positive temperature characteristic thermistor as set forth in claim 1, characterized in that said first electrode layers are made of one selected from a group of aluminum, indium, copper, indium-gallium and indium-mercury.

4. A method of manufacturing a positive temperature characteristic thermistor, characterized by comprising the steps of:

forming a thermistor main body by forming a semiconductor material having a positive temperature characteristic into a desired shape;

forming first electrode layers containing as their main component a metal other than silver on electrode formation surfaces of said thermistor main body by a vacuum vapor deposition process so that outer peripheral edges of said first electrode layers are located inside of outer peripheral edges of said thermistor main body; and forming second electrode layers containing silver as their main component and formed on said first electrode layers.

5. A method of manufacturing a positive temperature characteristic thermistor as set forth in claim 4, characterized in that the step of forming said second electrode layers is carried out by a vapor deposition process.

6. A method of manufacturing a positive temperature characteristic thermistor as set forth in claim 4, characterized in that the step of forming said second electrode layers is carried out by a thick film printing process.

* * * * *